US008886104B2

(12) United States Patent
Izawa et al.

(10) Patent No.: US 8,886,104 B2
(45) Date of Patent: Nov. 11, 2014

(54) FIXING APPARATUS FOR A SHEET-FED ELECTROPHOTOGRAPHIC PRINTER

(71) Applicant: Miyakoshi Printing Machinery Co., Ltd., Narashino (JP)

(72) Inventors: Hideo Izawa, Narashino (JP); Junichi Setoyama, Narashino (JP); Kenji Takahashi, Narashino (JP); Masaru Kusanagi, Yokote (JP)

(73) Assignee: Miyakoshi Printing Machinery Co., Ltd., Narashino-shi (JP)

( * ) Notice: Subject to any disclaimer, the term of this patent is extended or adjusted under 35 U.S.C. 154(b) by 42 days.

(21) Appl. No.: 13/654,029

(22) Filed: Oct. 17, 2012

(65) Prior Publication Data

US 2013/0101325 A1 Apr. 25, 2013

(30) Foreign Application Priority Data

Oct. 20, 2011 (JP) ..... 2011-230628

(51) Int. Cl.
*G03G 15/20* (2006.01)

(52) U.S. Cl.
CPC ..... *G03G 15/2028* (2013.01)
USPC ..... 399/330; 399/400; 399/322

(58) Field of Classification Search
CPC ..... G03G 15/2028; G03G 15/2021
USPC ..... 399/329, 330
See application file for complete search history.

(56) References Cited

U.S. PATENT DOCUMENTS 4,155,545 A * 5/1979 Yanagawa et al. ..... 271/10.09
4,276,978 A * 7/1981 Deguchi et al. ..... 198/803.1
4,404,905 A * 9/1983 Simeth et al. ..... 101/183
6,567,641 B1 * 5/2003 Stack et al. ..... 399/330
2006/0056886 A1 * 3/2006 Ohishi et al. ..... 399/322

FOREIGN PATENT DOCUMENTS

EP 1 642 739 A2 4/2006
JP 2006-330340 A 7/2006
JP 2006-259223 A 9/2006
JP 2006259223 A * 9/2006

OTHER PUBLICATIONS

Extended European Search Report dated Jun. 11, 2013, issued in corresponding European Patent Application No. 12189067.7 (3 pages).

* cited by examiner

*Primary Examiner* — Clayton E Laballe
*Assistant Examiner* — Leon W Rhodes, Jr.
(74) *Attorney, Agent, or Firm* — Westerman, Hattori, Daniels & Adrian, LLP

(57) ABSTRACT

A fixing apparatus includes a fixing drum having a heating heater internally equipped therein, the fixing drum positioned spaced part and downstream from a sheet delivery site at a downstream-most side of printing units and is adapted to rotate at a peripheral speed identical to a speed of travel of the sheet of paper. A first sprocket is positioned adjoining the sheet delivery site at the downstream-most side of the printing units, and a second sprocket is positioned coaxially with the fixing drum and being adapted to rotate integrally with the fixing drum. A conveyer chain having a gripper is wound around and engaging with the first and second sprockets to wind and convey a sheet of paper on a peripheral surface of the fixing drum upon gripping in turn with the gripper the sheet of paper traveling from the sheet delivery site at the downstream-most side.

6 Claims, 5 Drawing Sheets

FIXING APPARATUS FOR A SHEET-FED ELECTROPHOTOGRAPHIC PRINTER

TECHNICAL FIELD

The present invention relates to a fixing apparatus for a sheet-fed electrophotographic printer which allows sheets of paper to be printed on successively in a sheet-fed electrophotographic printing system.

BACKGROUND ART

As the conventional fixing apparatus of this type, there has hitherto been known an apparatus in which a plurality of (first and second) rolls around a heating roll are respectively brought into rotational contact with the heating roll to form nips, respectively, the rolls being positioned upper in the direction of gravity than the rotational shaft of the heating roll (see, e. g., JP 2006-330340 A).

In the makeup of such a prior-art fixing apparatus as cited above, two rollers around a heating roller are arranged spaced apart from each other by a distance in the direction of rotation of the heating roller and are brought into rotational contact with the heating roller. Then, a sheet of paper traveling as the heating roller rotates may float, leaving the heating roller in between the two rollers.

When a sheet of paper floats upon passing the first roller, problems arise. Thus, the nip by the second and heating rollers tends to cause such a sheet of paper to become crinkled. The higher the speed of transport of a sheet of paper becomes, the less sufficient the feed of fixing heat to the sheet of paper will be. In addition, the leading end of the sheet of paper on the way of its transport from the first nip to the second nip is freed, thereby making the transport per se unstable.

With the preceding problems taken into account, it is an object of the present invention to provide a fixing apparatus for a sheet-fed electrophotographic printer whereby a sheet of paper even in transport at higher speed can be transported stably without causing sheet crinkling and can be supplied enough with fixing heat, thereby achieving thermal fixing of an image with stabilized printing quality at higher speed.

DISCLOSURE OF THE INVENTION

In order to attain the object mentioned above, there is provided in accordance with the present invention a fixing apparatus for a sheet-fed electrophotographic printer in which an image printed by electrophotographically operating printing units on a sheet of paper traveling while being gripped by a gripper is heated and thereby photographically fixed, which apparatus comprises: a fixing drum having a heating heater internally equipped therein for heating a peripheral surface thereof, the fixing drum being positioned spaced apart and downstream from a sheet delivery site at a downstreammost side of the printing units, the fixing drum being adapted to rotate at a peripheral speed identical to a speed of travel of a sheet of paper in the printing units; a first sprocket positioned adjoining the sheet delivery site at the downstreammost side of the printing units, and a second sprocket positioned coaxially with the fixing drum, the second sprocket having a pitch circle diameter approximately identical to a circumferential diameter of the fixing drum, the second sprocket being adapted to rotate integrally with the fixing drum; a conveyer chain having a gripper, the conveyer chain being wound around and engaging with the first and second sprockets to wind and convey a sheet of paper on a peripheral surface of the fixing drum upon gripping in turn with the gripper the sheet of paper traveling from the sheet delivery site at the downstreammost side; and a pressure member adapted to be urged into rotational contact under pressure with a peripheral surface of the fixing drum.

Specifically in an apparatus made up as mentioned above, the fixing drum is rotatably supported by a fixed shaft and the fixing drum is provided with the heating heater.

Further, specifically in an apparatus made up as mentioned above, the second sprocket is made integral with the fixing drum and comprises a pair of sprocket components positioned at both sides of the fixing drum in its axial direction, the first sprocket comprises a pair of sprocket components corresponding to the pair of sprocket components of the second sprocket, respectively, the conveyer chain comprises a pair of chain components wound around and engaging with the two pairs of sprocket components, and a gripper of the chain components is arranged to bridge the pair of chain components and adapted to sink in a concave groove on a peripheral surface of the fixing drum while they are traveling as the fixing drum is rotated.

Also, specifically in an apparatus made up as mentioned above, the pressure member used to be urged into rotational contact with the fixing drum comprises either a pressure roller or a pressure belt adapted to be driven to rotate or travel at a peripheral speed identical to that of the fixing drum.

Also, specifically in an apparatus made up as mentioned above, a releasable jacket may removably be fitted over a peripheral surface of the fixing drum.

Further, specifically an apparatus made up as mentioned above may further comprise a heating unit positioned opposite to the conveyer chain traveling between the first and second sprockets for heating a surface of the sheet of paper in transport gripped with the gripper on the conveyer chain.

According to the present invention, a sheet of paper printed on by the sheet-fed electrophotographic printer can stably be transported, heated and photographically fixed, by being wound and conveyed on the fixing drum in the state that it is gripped by the gripper on the conveyer chain. Moreover, by being placed under pressure by a pressure member urged into pressure contact with the peripheral surface of the fixing drum, the sheet of paper wound and conveyed on the peripheral surface of the fixing drum can be photographically fixed stably and homogeneously while being allowed to travel at a high speed.

Also, by being perfectly fixed with the gripper on the conveyer chain, a sheet of paper transported and introduced into the fixing apparatus is prevented from slipping and can thus be held securely in position with accuracy. And, means to transport sheets of paper in the fixing apparatus is included in the form of a conveyer chain incorporating grippers, allowing the structure of fastening sheets of papers while in transport for fixing to be implemented in a simplified makeup. Economical effects can thus been achieved in respect of cost as well.

The fixing drum which in the present fixing apparatus may be rotatably supported on a fixed shaft allows the heating heater provided inside of the drum to be securely arranged in the fixed shaft, and makes it possible to provide a heater power supply and control circuit readily via the inside of the fixed shaft in a simple structure.

Also, a releasable jacket that may be fitted over a peripheral surface of the fixing drum according to the present invention makes it possible to prevent a printed toner image, even if in duplex printing, from possibly transferring onto a surface of the fixing drum and thus to obtain a toner image fixed at uniform and high quality. And, the releasable jacket made removable betters its maintainability.

Further, a heating unit which may be provided in a region where a sheet of paper transported from the sheet-fed electrophotographic printer and gripped in turn with a gripper on the conveyer chain is being conveyed onto the fixing drum allows a toner image printed on the sheet of paper to be softened and melted by preliminarily heating, thereby facilitating thermal fixing on the fixing drum. Moreover, an increase in the speed of transport of sheets for fixing and of sheet fixing can be achieved. And, an implementation of the invention is thus provided which though it allows fixing at high speed can be made in a simple structure without rendering the apparatus large in size.

BEST MODES FOR CARRYING OUT THE INVENTION

Figure 1:
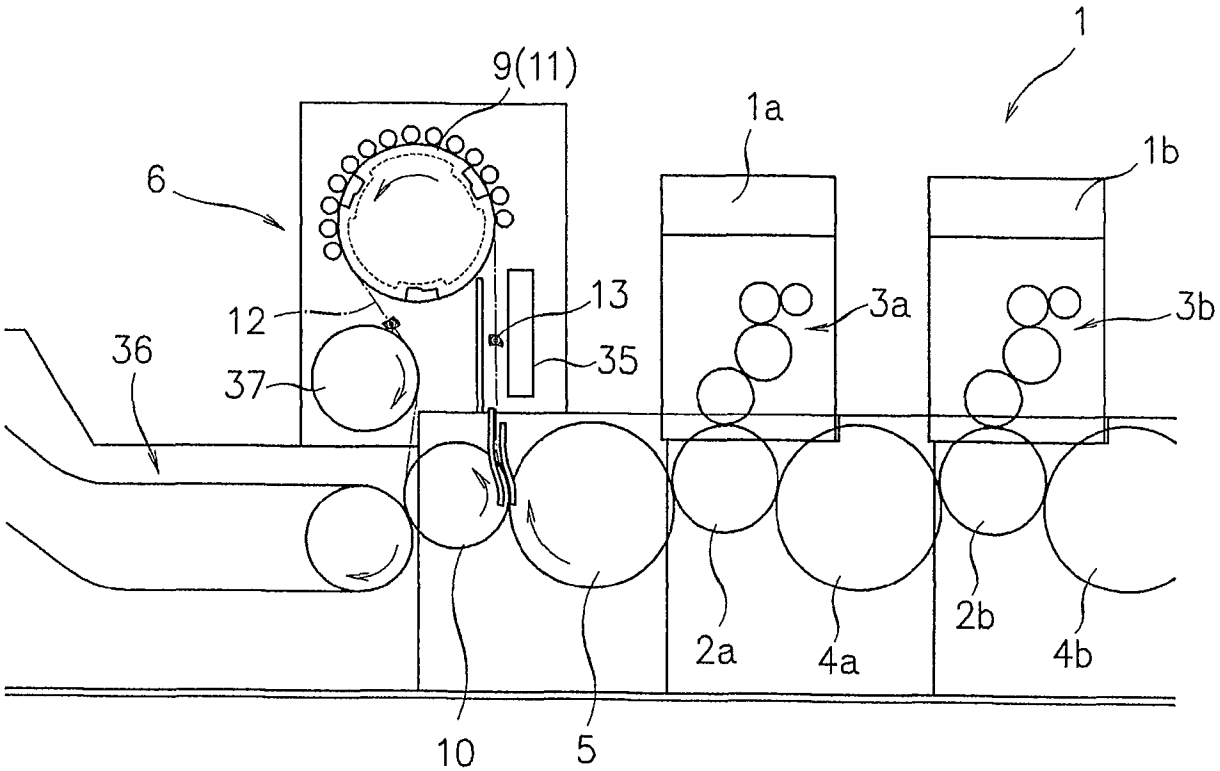
FIG. 1 is a diagrammatic makeup illustration showing an overall system incorporating the present invention.
Figure 2:
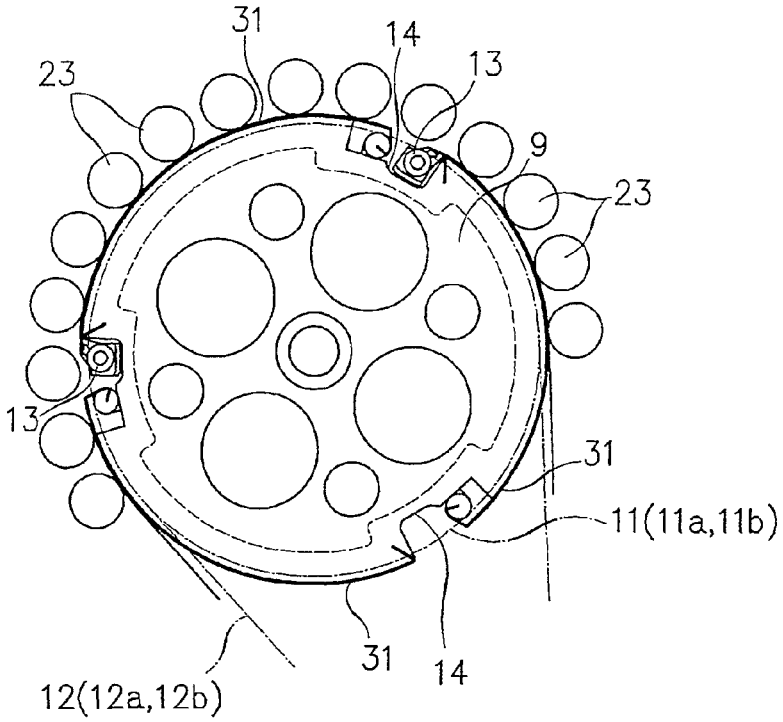
FIG. 2 is a diagrammatic makeup illustration showing a fixing drum unit in a fixing apparatus.

An explanation will now be given of forms of implementation of the present invention with reference to the Drawing Figures.

FIG. 1 shows a sheet-fed electrophotographic printer 1 using electrophotographic printing means to print on a sheet of paper in a single color or in a plurality of (e. g., four) colors, the printer comprising a series of printing units 1*a*, 1*b*, . . . for printing in the color or colors. The printing units 1*a*, 1*b*, . . . comprise printing cylinders 3*a*, 3*b*. . . opposite to impression cylinders 2*a*, 2*b*, . . . , respectively. Shown at 4*a*, 4*b*, . . . are delivery cylinders for receiving and delivering a sheet of paper between the two impression cylinders 2*a*, 2*b*, . . . in the adjacent printing units 1*a*, 1*b*, . . . , respectively. Indicated at 5 is a delivery cylinder for receiving a sheet of paper from the impression cylinder 2*a* in the printing unit la at a side downstreammost in the direction of its transport and delivering the sheet of paper into a fixing apparatus 6 arranged downstream of the sheet-fed electrophotographic printer 1.

The impression cylinders 2*a*, 2*b*, . . . , the delivery cylinders 4*a*, 4*b*, . . . and further the delivery cylinder 5 in the sheet-fed electrophotographic printer 1 are provided on their respective peripheral surfaces with grippers not shown in FIG. 1, the grippers on each of the peripheral surfaces being positioned equally spaced apart from one another thereon at a distance corresponding to a longitudinal length of each of sheets of paper so that sheets of paper fed from an upstream side of the sheet-fed electrophotographic printer 1 may be successively transported while being gripped in turn by these grippers on those cylinders.

In FIG. 1, the fixing apparatus 6 mentioned above is shown disposed downstream of the delivery cylinder 5 in the sheet-fed electrophotographic printer 1 so that toner images electrophotographically printed on each sheet of paper by the printing units 1*a*, 1*b*, . . . in the sheet-fed electrophotographic printer 1 may be heated and thereby photographically fixed. Mention is now made below of the makeup of this fixing apparatus with reference to the Drawing Figures.

Figure 3:
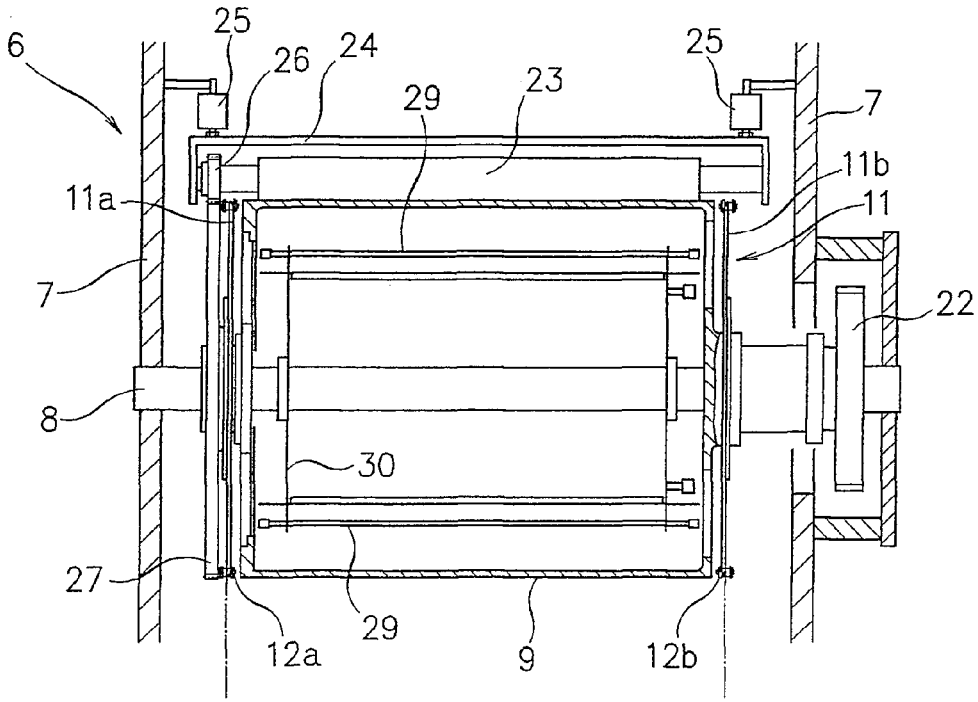
FIG. 3 is a sectional view illustrating the fixing drum unit.

The fixing apparatus 6 comprises a fixing drum 9 disposed at a position spaced apart by a given distance downstream, e. g., upwards, of the delivery cylinder 5 of the sheet-fed electrophotographic printer 1, the drum 9 being rotatably supported by a supporting shaft 8 fastened to a right hand and a left hand side frame 7 and 7 as shown in FIG. 3. It also comprises a first sprocket 10 (FIG. 1) disposed adjoining the delivery cylinder 5, a second sprocket 11 coaxially integrated with the fixing drum 9 and having a pitch circle diameter about identical to an outer diameter of the fixing drum 9, and a conveyer chain 12 wound around and engaging with these sprockets 10 and 11.

The conveyer chain 12 has a length that is an integral multiple of a spacing of the grippers in a sheet transport path of the sheet-fed electrophotographic printer 1, the conveyer chain 12 having grippers 13 provided each at a position for each of such spacing for gripping a sheet of paper transported in the sheet transport path.

The fixing drum 9 has an axial length wider than a width of a sheet of paper and has a peripheral length that is an integral multiple of, e. g., three times of, a length of the spacing between the grippers 13. The peripheral surface of the fixing drum 9 is formed with concave grooves 14 each of which is at a position for each of such spacing of the grippers 13 and in which the grippers 13 traveling integrally with the conveyer chain 12 are sunk.

Further, the second sprocket 11 as shown in FIG. 3 is comprised of a pair of sprocket components 11*a* and 11*b* positioned at both sides of the fixing drum 9 in its axial direction. And, the first sprocket 10 is likewise comprised of a pair of sprocket components 10*a* and 10*b* (see FIG. 6) corresponding to the pair of sprocket components 11*a* and 11*b*, respectively, while being mounted rotatably as they are and being spaced from each other at a distance identical to that between them. And, the conveyer chain 12 is comprised of a pair of chain component 12*a* and 12*b* wound around and engaging with the sprocket components 10*a* and 10*b;* and 11*a* and 11*b*, respectively. Each of the grippers 13 is supported by the chain components 12*a* and 12*b* so as to bridge these chain components.

Figure 4:
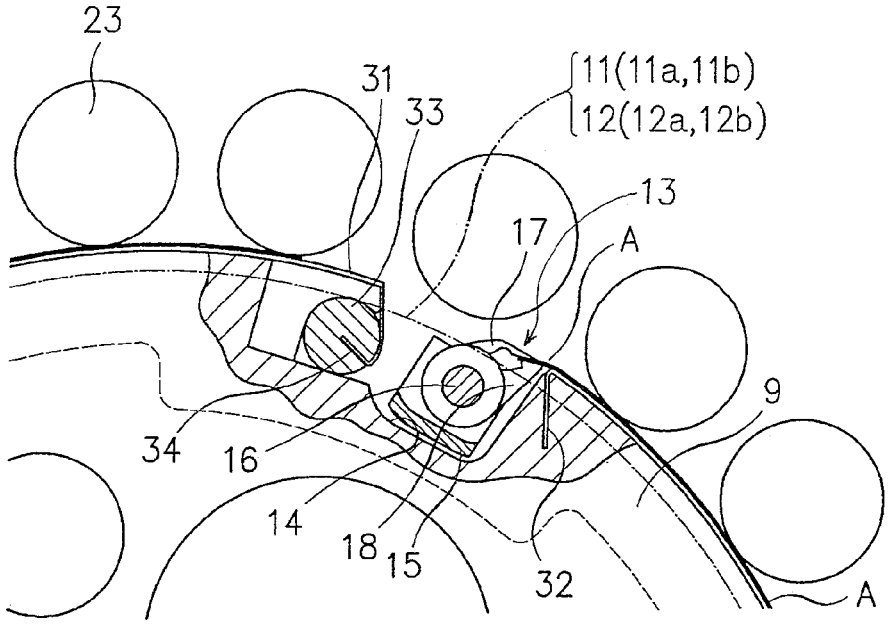
FIG. 4 is a diagrammatic makeup illustration showing, in part cut away, an essential portion of the fixing drum unit.
Figure 5:
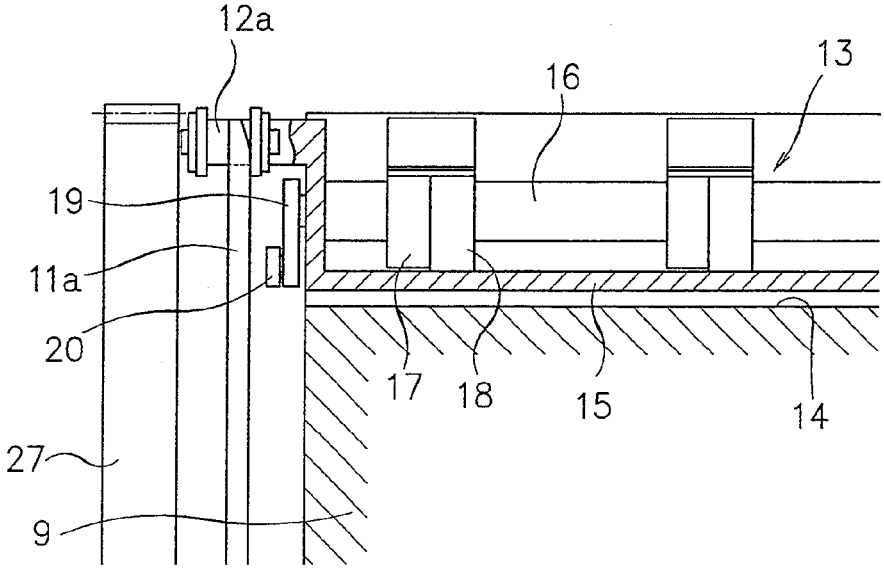
FIG. 5 is a sectional view illustrating a gripper in the fixing drum unit.

The gripper 13 made as shown in FIGS. 3 and 4 comprises a connecting member 15 bridging a pair of chain components 12*a* and 12*b*, a rotary shaft 16 rotatably supported by the connecting member 15, a plurality of rotary fingers 17 fastened to a plurality of positions of the rotary shaft 16 in its axial direction and a plurality of fixed fingers 18 fastened to the connecting member 15 so as to be opposite to the rotary fingers 17, respectively.

The fixed fingers 18 in the gripper 13 towards their ends are formed to lean upstream in the direction of travel of the conveyer chain 12 so that rotation of the rotary fingers 17 in a direction in which they close with respect to the fixed fingers 18 grips the leading end of a sheet of paper A in its transport direction with both the fingers 17 and 18.

Gripping a sheet of paper A in this way, the gripper 13 which at a position at which it is opposite to the peripheral surface of the fixing drum 9 is sunk in the concave groove 14 formed on the peripheral surface of the fixing drum 9 as mentioned above, it being noted that the end of the gripper 13 as shown in FIG. 4 is made to come barely into the concave groove 14.

A lever member 19 provided with a cam follower 20 is fastened to one or each of both ends of the rotary shaft 16 which protrude out of the connecting member 15. The cam follower 20 is contacted with a cam (not shown) at the delivery site of a sheet of paper A where a gripper 13 is opposite to the delivery cylinder 5 to swing the lever member 19 and in turn to rotate the rotary shaft 16 back and forth by an angle, thereby causing the rotary fingers 17 to open and close with respect to the fixed fingers 18. Thus, at the sheet delivery site a sheet of paper transported while being gripped by a gripper on the delivery cylinder 5 is allowed to be gripped in turn by a gripper 13 on the conveyer chain 12.

Figure 6:
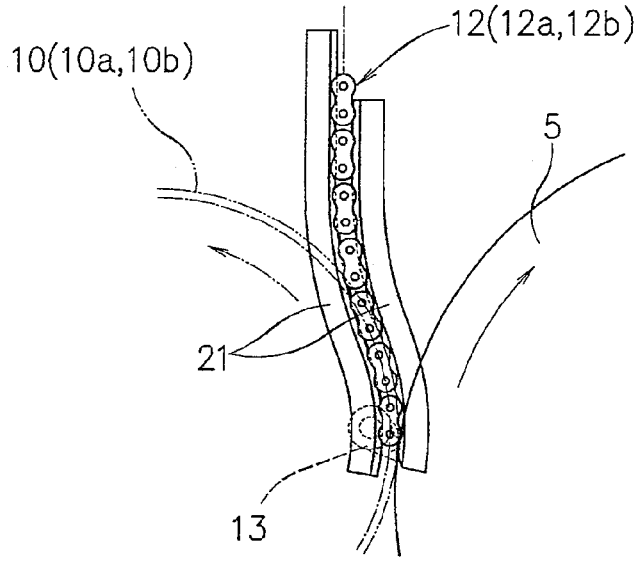
FIG. 6 is an explanatory view illustrating a section for gripping in turn of a sheet of paper being carried from the delivery unit of a printer into the fixing apparatus.

In FIG. 6, there is shown a section in which a sheet of paper A is gripped in turn from a gripper on the delivery cylinder 5 to a gripper 13 on the conveyer chain 12 in the fixing apparatus 6. This section is provided with a chain guide member 21 for guiding the conveyer chain 12.

Figure 7:
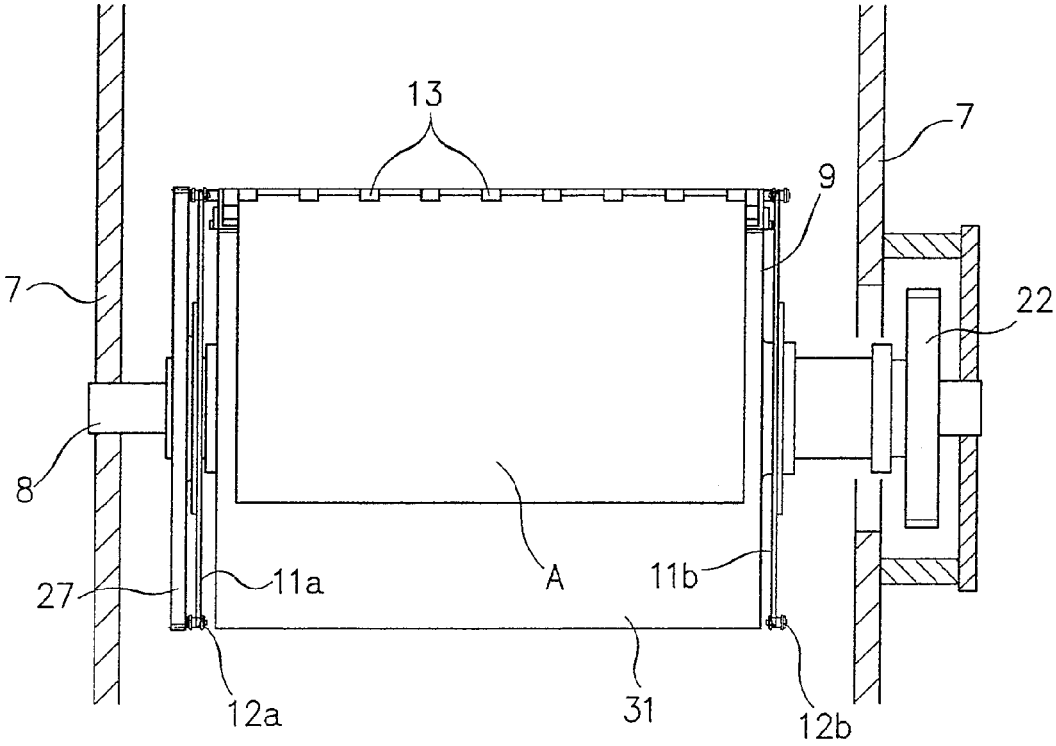
FIG. 7 is a front view of the fixing drum unit.

In FIG. 7 there is shown a state that a gripper 13 travels around the fixing drum 9. A sheet of paper A gripped by the gripper 13 in this state is allowed to travel, being held to be wound on the peripheral surface of the fixing drum 9.

As shown in FIG. 3, the fixing drum 9 at one of its axial ends has a driven pulley 22 fastened thereto, by way of which the fixing drum 9 is driven to rotate at a peripheral speed identical to a speed of sheet transport in the printing units 1*a*, 1*b*, . . .

In addition, the fixing drum 9 is surrounded by a plurality of pressure rollers 23 for rotational contact with the peripheral surface of the fixing drum 9. The pressure rollers 23 are rotatably supported in increments of plurality by supporting frames 24. Each of the supporting frames 24 is supported by the right and left hand frames 7 and 7 via cylinders 25 and 25 that allow mounting and removal of the pressure rollers 23. It is here made possible for the pressure rollers 24 to be brought into and out of contact with the peripheral surface of the fixing drum 9 for each of the supporting frames 24.

Each of the pressure roller 23 is provided at its one axial end with a small gear 26 fastened thereto. The small gears 26 are each made in mesh with a large gear 27 provided fastened to the fixing drum 9 coaxially therewith. Each small gear 26 has a pitch circle diameter identical to a diameter of each pressure roller 23, and the large gear 27 has a pitch circle diameter identical to the diameter of the fixing drum 9. With the gears 26 made in mesh with the gear 27, it is ensured that the pressure rollers 23 are rotated at a peripheral speed identical to that of the fixing drum 9 without bringing about a looseness in the direction of rotation. The pressure rollers 23 are then held to be urged under pressure by the pressure cylinders 25 and 25 towards the peripheral surface of the fixing drum 9. Note here that the extent of urging by the pressure rollers 23 towards the fixing drum 9 is limited by stopper means (not shown).

Figure 8:
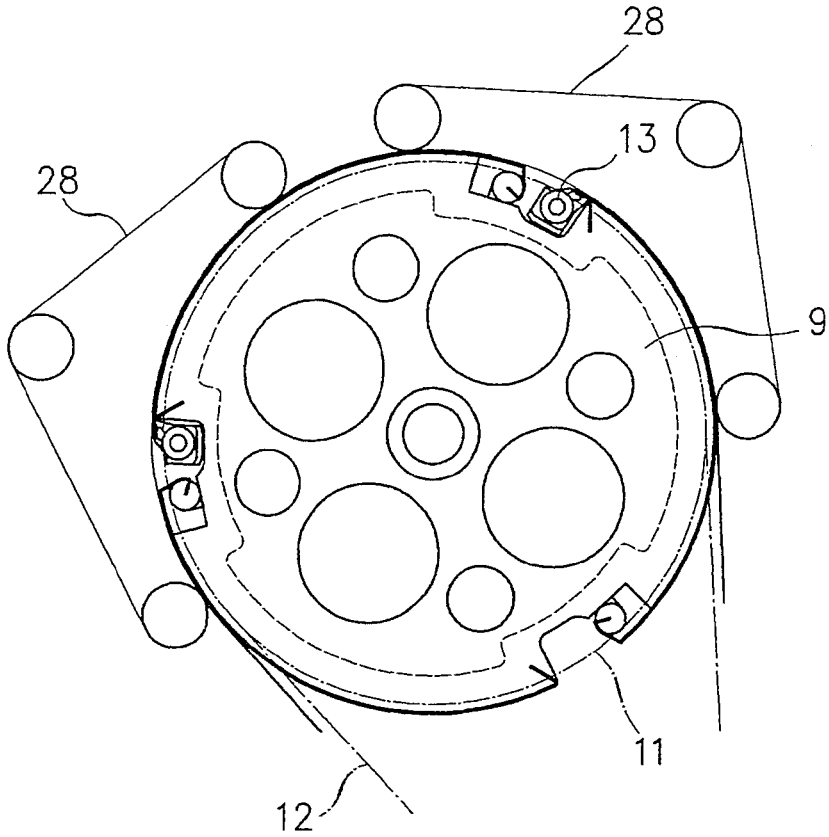
FIG. 8 is a makeup illustration diagrammatically showing an alternative embodiment of a pressure member acting on the fixing drum unit.

As shown in FIG. 8, it is also possible to use pressure belts in place of the pressure rollers 23 mentioned above. In this case as well, the pressure belts 28 are driven to travel at a peripheral speed and in a direction identical to those of the fixing drum 9.

The fixing drum 9 as shown in FIG. 3 is hollow and is provided in its inside with a heating heater 29 such as an IR heater which is supported by the supporting shaft 8 via a heater retainer 30. And, the heating heater 29 has its electric wiring connected from a power controllable power supply unit (not shown) through hollows (not shown) in the supporting shaft 8 such that heating the surface of the fixing drum 9 may properly be controlled in accordance with operation conditions of the apparatus.

The fixing drum 9 as shown in FIG. 4 is provided on a surface or surfaces over between the concave grooves 14, 14 with a releasable jacket 31 removably attached thereto. The downstream end of a releasable jacket 31 is inserted into and engaged with a slot 32 which is formed in the upstream end of a concave groove 14. The upstream end of a releasable jacket 31 is inserted into and engaged with a slot 34 in a fastening shaft 33 positioned at the downstream portion of a concave groove 14. Rotating the fastening shaft 33 on a fastening direction makes the releasable jacket 31 tense to tightly cover over the peripheral surface of the fixing drum 9 between the concave grooves 14 and 14 therewith.

Also, in the path of travel of the conveyer chain 12 that extends from the first sprocket 10 to the second sprocket 11, specifically outside in position of the conveyer chain 12 extending over between the delivery site of a sheet of paper A from the delivery cylinder 5 onto the conveyer chain 12 and the second sprocket 11, a heating heater 35 such as an IR heater is positioned opposite to the sheet of paper A traveling and gripped by a gripper 13 of the conveyer chain 12.

In the downstream of the fixing apparatus 6 mentioned above there is provided a discharge conveyer 36 whereby a sheet of paper A photographically fixed in the fixing apparatus 6 is carried out downstream. Further, a tension sprocket 37 is shown that is made in mesh with the conveyer chain 12 in the fixing apparatus 6 and that is urged by a spring in a direction in which a tension is to be imparted to the conveyer chain 12.

In the makeup mentioned above, a sheet of paper A having been printed on by the sheet-fed electrophotographic printer 1 and transported, in the adjoining area between the delivery cylinder 5 and the first sprocket 10 of the fixing apparatus 6, is gripped in turn by a gripper 13 mounted on the conveyer chain 12 wound around the first sprocket 10 and the second sprocket 11 and then is transported towards the fixing drum 9. Then, in the path of travel immediately following the sheet delivery site, a surface of the sheet of paper A is preliminarily heated by the heater 35 whereby a toner image printed on the sheet of paper A is softened for melting.

After that, as the conveyer chain 12 travels, the gripper 13 gripping the sheet of paper A is sunk in a concave groove 14 on the fixing drum 9 to move around the fixing drum 9. Following this, the sheet of paper A is wound around the fixing drum 9 to travel whereby in the meantime the toner image on the sheet of paper A is heated by the peripheral surface of the fixing drum 9 which surface is heated by the heating heater 29 and is fixed thereon. The sheet of paper A with the toner image fixed by the fixing apparatus 6 is gripped in turn by the discharge conveyer 36 and carried out downstream.

In this case: being gripped and fixed by a gripper 13 on the conveyer chain 12, a sheet of paper A on a surface of the fixing drum 9 brings about no deviation in position from the drum surface. Also, since a sheet of paper A on the fixing drum 9 is transported as nipped with the pressure rollers 23 or the pressure belts 28 which are rotated in synchronism in speed with the fixing drum 9, its transportation is rendered stable, accurate and rapid. Without causing sheet crinkling, there can thus be achieved stabilized fixing of toner images on sheets of paper A.

Further, by repetitive pressure fixing with a fixing drum 9 that may be large in diameter permitting a heating heater to be arranged comprising a number of IR heaters at positions proximal to its inner periphery, in combination with a plurality of pressure rollers 23 or pressure belts 28, toner images can be fixed rapidly, homogeneously and stably.

Also, since the transport system is with a conveyer chain 12, the distance of heating by a heater 35 provided in its linear traveling section for preliminary heating can be altered freely in accordance with the applications only by setting the length of the conveyer chain 12. Further, by proving the heater 35 in a region upper than the delivery site of sheets of paper A, it is ensured that altering the distance of preliminary heating to be longer will have no influence on the total length of an apparatus.

Further, using a conveyer chain 12 in transporting sheets of paper A in a fixing apparatus 6 simplifies the makeup of the fixing apparatus 6.

Also, applying a releasable jacket 31 removably to the surface of a fixing drum 9 can, such as in duplex printing, prevent a toner image from transferring to a surface of the fixing drum.

While in the forms of implementation described above, the grippers 13 are illustrated as mounted at positions corresponding to a peripheral surface of the fixing drum 9, it may be noted that it is also possible depending on conditions of sheets of paper such as sheet width and paper quality to mount grippers 13 on chain components 12*a* and 12*b* at both outsides of the fixing drum 9 in its axial direction, respectively. In that case, the grippers 13 need not to bridge between the chain components 12*a* and 12*b* provided on both sides of the fixing drum 9, thus it is unnecessary to make concave grooves 14 on the peripheral surface of the fixing drum 9.

What is claimed is:

1. A fixing apparatus for a sheet-fed electrophotographic printer in which an image printed by electrophotographically operating printing units on a sheet of paper traveling while being gripped by a gripper is heated and thereby fixed, comprising:

a fixing drum having a heating heater internally equipped therein for heating a peripheral surface thereof, the fixing drum being positioned spaced apart and downstream from a sheet delivery site at a downstreammost side of the printing units, the fixing drum being adapted to rotate at a peripheral speed identical to a speed of travel of a sheet of paper in said printing units;

a first sprocket positioned adjoining said sheet delivery site at the downstreammost side of said printing units, and a second sprocket positioned coaxially with said fixing drum, the second sprocket having a pitch circle diameter approximately identical to a circumferential diameter of the fixing drum, the second sprocket being adapted to rotate integrally with the fixing drum;

a conveyer chain having a gripper, the conveyer chain being wound around and engaging with said first and second sprockets to wind and convey a sheet of paper on a peripheral surface of the fixing drum upon gripping in turn with the gripper the sheet of paper traveling from the sheet delivery site at said downstreammost side; and a pressure member adapted to be urged into rotational contact under pressure with a peripheral surface of said fixing drum.

2. A fixing apparatus for a sheet-fed electrophotographic printer as set forth in claim 1, wherein the fixing drum is rotatably supported by a fixed shaft and the fixed shaft is provided with said heating heater.

3. A fixing apparatus for a sheet-fed electrophotographic printer as set forth in claim 1, wherein the second sprocket is made integral with the fixing drum and comprises a pair of sprocket components positioned at both sides of the fixing drum in its axial direction, the first sprocket comprises a pair of sprocket components corresponding to the pair of sprocket components of the second sprocket, respectively, the conveyer chain comprises a pair of chain components wound around and engaging with the two pairs of sprocket components, and a said gripper of the chain components is arranged to bridge the pair of chain components and adapted to sink in a concave groove on a peripheral surface of the fixing drum while they are traveling as the fixing drum is rotated.

4. A fixing apparatus for a sheet-fed electrophotographic printer as set forth in claim 1 wherein the pressure member to be urged into rotational contact with the fixing drum comprises either a pressure roller or a pressure belt adapted to be driven to rotate or travel at a peripheral speed identical to that of the fixing drum.

5. A fixing apparatus for a sheet-fed electrophotographic printer as set forth in claim 1, wherein a releasable jacket is removably fitted over a peripheral surface of the fixing drum.

6. A fixing apparatus for a sheet-fed electrophotographic printer as set forth in claim 1, further comprising a heating unit positioned opposite to the conveyer chain traveling between the first and second sprockets for heating a surface of the sheet of paper in transport gripped with the gripper on the conveyer chain.

* * * * *